US006158547A

United States Patent [19]

Ackermann et al.

[11] Patent Number: 6,158,547

[45] Date of Patent: Dec. 12, 2000

[54] PROCESS FOR MANUFACTURING AN ABSORPTION MUFFLER

[75] Inventors: Roland Ackermann, Neunkirchen; Bernd Müller, Illingen; Norbert Klein, Neunkirchen, all of Germany

[73] Assignee: J. Eberspächer GmbH & Co., Germany

[21] Appl. No.: 09/218,222

[22] Filed: Dec. 22, 1998

[30] Foreign Application Priority Data

Dec. 24, 1997 [DE] Germany ..... 197 57 810
Mar. 14, 1998 [DE] Germany ..... 198 11 192

[51] Int. Cl.[7] ..... F01N 1/24

[52] U.S. Cl. ..... 181/256; 29/890.08

[58] Field of Search ..... 181/252, 255, 181/256, 258, 269, 272, 282; 29/890.08

[56] References Cited

U.S. PATENT DOCUMENTS 4,774,985 10/1988 Broadbelt et al. ..... 29/890.08

FOREIGN PATENT DOCUMENTS 0 091 413 B2 5/1987 European Pat. Off. .

*Primary Examiner*—Khanh Dang
*Attorney, Agent, or Firm*—McGlew and Tuttle, P.C.

[57] ABSTRACT

To prepare an absorption muffler for motor vehicles with a sound-absorbing material arranged in a hollow space of an exhaust muffler body in the form of glass wool (2), which is introduced into the hollow space in the form of an expanded, endless glass fiber roving, it is proposed that the exhaust muffler body (1) be completely prefabricated and assembled before the glass wool (2) is introduced into the prefabricated, assembled exhaust muffler body (1) from the outside.

18 Claims, 4 Drawing Sheets

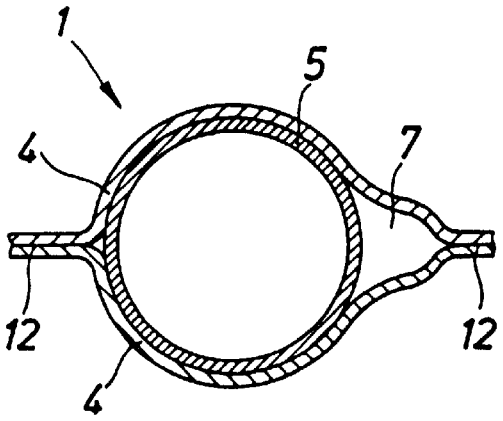
Fig. 4
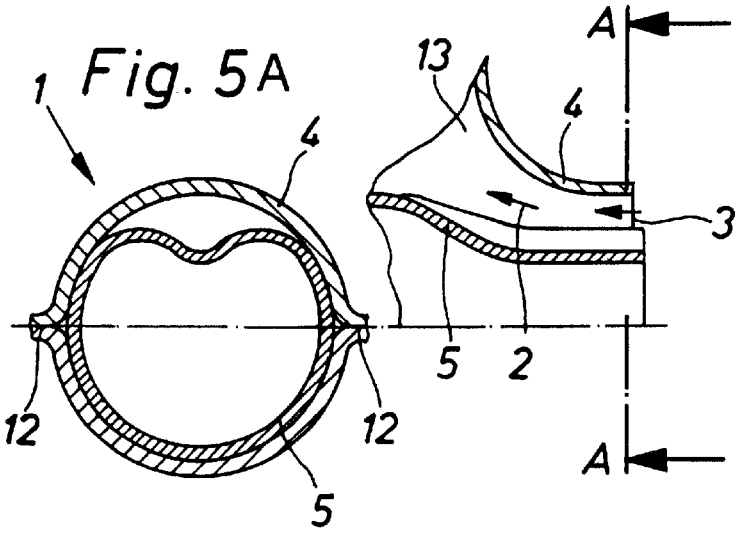
Fig. 5A
Fig. 5B
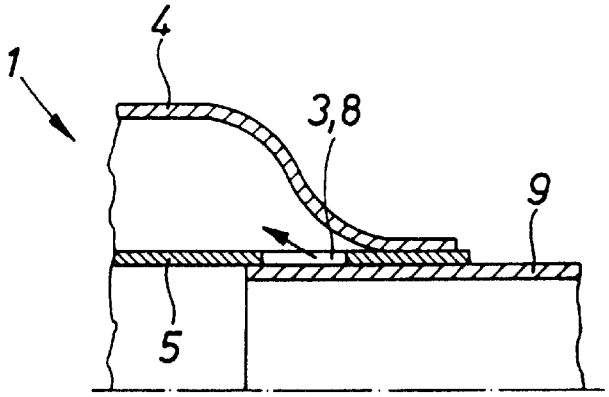
Fig. 6

PROCESS FOR MANUFACTURING AN ABSORPTION MUFFLER

FIELD OF THE INVENTION

The present invention pertains to a process for manufacturing an absorption muffler for motor vehicles with a sound-absorbing material arranged in an exhaust muffler body, as well as to an absorption muffler of the half shell or wound design manufactured according to those processes, wherein sound-absorbing material in the form of glass wool is introduced as an expanded endless glass fiber roving into a hollow space of the exhaust muffler body.

BACKGROUND OF THE INVENTION

Absorption mufflers have been known to have annular gaps and/or chambers, in which the sound-absorbing material, especially glass wool, is arranged. The sound-absorbing material is arranged around the blank of an inner shell or around an inner tube before the final mounting of the outer shell and before the outer shell is permanently connected to the inner shell or to the inner tube, e.g., via a fold or by welding. The arrangement of the noncompact, flexible sound-absorbing material in the areas intended for this purpose or in the chambers of an exhaust muffler intended for this purpose and the subsequent assembly of the exhaust muffler body are comparatively laborious and expensive operations.

SUMMARY AND OBJECTS OF THE INVENTION

The primary object of the present invention is to provide a simplified process for manufacturing an absorption muffler with simple means and to correspondingly prepare an exhaust muffler in a simple manner.

A further object of the invention is to provide an absorption muffler which is simple in design, rugged in construction and economical to manufacture.

According to the invention, a process for preparing an absorption muffler for motor vehicles is provided in which a sound-absorbing material in the form of glass wool is arranged in a hollow space of the exhaust muffler body. The glass wool is introduced as expanded, endless glass fiber roving into the hollow space. The exhaust muffler body is completely prefabricated and assembled. The glass wool is subsequently introduced into the said prefabricated, assembled exhaust muffler body from the outside.

According to another aspect of the invention a sound absorption muffler is provided. The glass wool is introduced, subsequent to the formation of the muffler body, from the outside of the muffler body. The outer skin or outer shell of the muffler body has at least one said filling opening through which the glass wool has been subsequently introduced into the assembled, prefabricated exhaust muffler body and which is closed after the introduction of the glass wool.

The filling opening of the exhaust muffler body subsequently provided with the glass wool may ave a welded closure in the form of a welded plug. The filling opening may also have riveted closure.

The muffler body may have a pressed-on outer shell or an at least partially compressed outer shell, which is optionally also welded. The inner shell, deformed at least partially on its circumference or a deformed inner pipe of the exhaust muffler body provided with the glass wool, may then be restored to its original shape. The inner shell or the inner pipe of the exhaust muffler body may be provided with a hole or a jacket perforation, which is closed by an intermediate pipe. The intermediate pipe may be pushed in after the introduction of the glass wool.

The essence of the process according to the present invention for manufacturing an absorption muffler is that the sound-absorbing material, namely, glass wool, is subsequently introduced from the outside into the completely prefabricated and completely assembled exhaust muffler body, namely, into the finished product.

Even though it has been known from EP 091 413 B2 that an exhaust muffler of the type described in the introduction can be manufactured, in which glass wool is introduced as an expanded, endless glass fiber roving into the exhaust muffler body, the glass wool is introduced not into the finished product, namely, a completely prefabricated, assembled exhaust muffler body, but via a fully open front side of the exhaust muffler or through a circumferential gap of an only partially assembled exhaust muffler body. Once the glass fiber has been filled in, the front wall of the exhaust muffler is inserted or the coaxial inner part of the exhaust muffler is pushed completely into the outer part of the exhaust muffler in order to close the front side or the circumferential gap. The subsequent pushing in of the inner part of the exhaust muffler body into the outer part is comparatively expensive and not uncomplicated. The glass wool packed in may hinder the assembly and may cause jamming.

In contrast, the inner space to be filled with glass wool is exactly predetermined in the present invention by the prefabricated, complete design of the exhaust muffler body and can be packed with glass wool even in the most remote corners, without hindrance or jamming occurring, as is the case in the above-mentioned state of the art, because no final assembly of the exhaust muffler body must be performed any more after the filling.

In a variant of the present invention, provisions are made for introducing the glass wool by means of at least one rigid filling pipe or a flexible filling tube via one or more filling openings provided in the exhaust muffler body, wherein the filling openings may be provided in different areas, depending on the type of the construction of the exhaust muffler, namely, on the outer jacket or on the outer skin and/or on the inner shell or on the inner pipe, namely, at a radial point of the jacket and/or at an axial front-side point on the outer jacket and/or on the outer jacket or on the inner shell. As a result, it is possible to pack even more complicated hollow spaces with glass wool simply and rapidly and especially with constant density, even in the most remote corners. The (small) filling openings may be closed again without problems after the removal of the filling pipe or filling tube.

The glass wool is preferably pressed under pressure into the exhaust muffler body through the filling pipe or the filling tube and/or it is drawn by vacuum into the inside of the exhaust muffler body.

The filling openings are advantageously prepared before or after the assembly of an exhaust muffler body and are again closed after the introduction of the sound-absorbing material.

In particular, the outer skin or the outer shell of the exhaust muffler body is incised for preparing the filling opening, and the incised section is deformed, so that a filling gap is formed. After the introduction of the glass wool, the deformed, incised section is restored to its original shape and is optionally welded to the rest of the outer skin or the outer shell.

In particular, a gap between an inner pipe and an outer skin or outer shell of an exhaust muffler body, which outer skin or outer shell partially bulges out at the end on its circumference, is pushed back after the introduction of the sound-absorbing material and is optionally welded.

An inner pipe partially deformed in the inward direction on its circumference on the inside may also be restored to its original, preferably round shape after the introduction of the glass wool.

After the introduction of the glass wool into the exhaust muffler body, a hole or a jacket perforation in the inner shell or in the inner pipe may be closed, in particular, by pushing an intermediate pipe into the inner shell or into the inner pipe. The hole or holes is/are pressure-equalizing openings, which ensure the equalization of the pressure during the filling in of the glass wool. The holes may possibly also be used to fill the inner space with glass wool.

Consequently, sound-absorbing material in the form of glass wool, introduced subsequently into the completely prefabricated and completely assembled exhaust muffler body from the outside, is provided in an absorption muffler manufactured according to the present invention.

The outer skin or outer shell has at least one filling opening, through which the glass wool is introduced and which is closed after the introduction of the glass fool.

The filling opening of an exhaust muffler body that is subsequently filled with glass wool may have a welded closure in the form of a welded plug or, as an alternative, a riveted closure.

The exhaust muffler body filled with glass wool may have a pressed-on outer shell or an at least partially compressed outer shell, which may optionally also be welded.

An inner shell deformed on the front side or an inner pipe of a glass wool-filled exhaust muffler body, which inner pipe is deformed on the front side, is preferably restored to its original shape, preferably by means of a mandrel.

The inner shell or the inner pipe of the exhaust muffler body preferably has a hole or a jacket perforation for pressure equalization during the filling in of the glass wool, which is closed by an intermediate pipe pushed in after the introduction of the glass wool. The hole or the jacket perforation may also be used to introduce the glass wool into the interior of the exhaust muffler body.

Consequently, glass wool is introduced according to the present invention into the exhaust muffler body after folding and welding from the outside via one or more holes by means of a probe or a filling tube or pipe. The holes are subsequently closed. Such a manufacturing process saves manufacturing time and assembly time compared with the prior-art processes mentioned in the introduction, which leads to competitive advantages. Glass wool as a filling material is environmentally friendly (better than basalt fibers).

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the Drawings

FIG. 4 is a cross sectional view of an exhaust muffler body with a filling channel or gap provided in the area of the outer shell;

FIG. 5A is a cross sectional view of an exhaust muffler body of the embodiment of FIG. 4 wherein the section is taken along line 5A—5A of the partial longitudinal section shown in FIG. 5B;

FIG. 5B is a partial longitudinal sectional view of the embodiment of FIG. 4, showing the provision of a filling channel or gap in the area of the inner shell or inner pipe by deforming the inner pipe;

FIG. 6 is a partial axial sectional view showing an exhaust muffler body of another design variant;

DESCRIPTION OF THE PREFERRED EMBODIMENT

Figure 1:
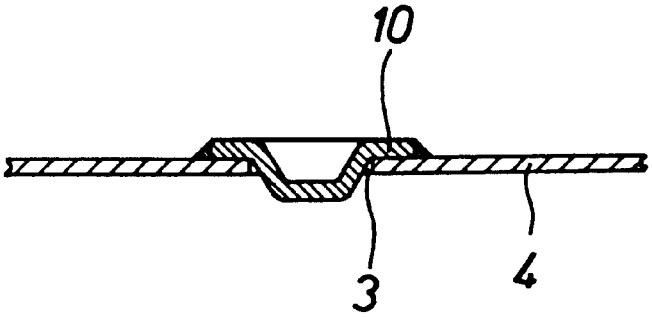
FIG. 1 is a cross sectional view of a filling opening in an outer shell of an exhaust muffler of the half shell design with a welded closure in the form of a welded plug.

Referring to the drawings and in particular to FIGS. 1 through 8, an absorption muffler comprises an exhaust muffler body 1 of the shell design. In particular, the exhaust muffler has two outer half shells 4 and a closed inner pipe 5.

In an area that is not of particular interest here, there is an absorption chamber with sound-absorbing material in the form of glass wool 2 between the two outer shells 4 and the inner pipe 5.

The glass wool 2 is introduced subsequently from the outside into the completely prefabricated and completely assembled exhaust muffler body 1 by means of a probe or a rigid filling pipe 15 or a flexible filling tube with or without a nozzle attached to its end. Before filling the hollow space 13, the filling pipe 15 is introduced into a filling opening 3 of the exhaust muffler body 1, which was prepared before, and endless glass fiber material is subsequently packed under pressure into the interior of the exhaust muffler body from a storage container or a glass wool roll, while the glass fibers expand and become entangled to form a so-called glass fiber roving, such that the entire hollow space 13 to be filled will be filled practically with the same density up to the most remote corner. After the introduction of the glass wool, the filling pipe 15 is pulled out of the filling opening and the filling opening is again closed.

The exhaust muffler shown partially in FIGS. 4 through 6 consequently has a completely prefabricated exhaust muffler body 1 in the form of an inner pipe 5, which is surrounded by the two outer half shells 4, wherein the inner pipe 5 and the outer shells 4 are firmly connected to one another by a fold 12 in the area of the outer shells 4. A hollow space 13 to be filled with glass wool 2 is located in an axial central area between the inner pipe 5 and the outer shells 4.

The filling opening 3 may have different designs and is approximately the same size as the filling pipe 15, as shown in the drawings.

Figure 2:
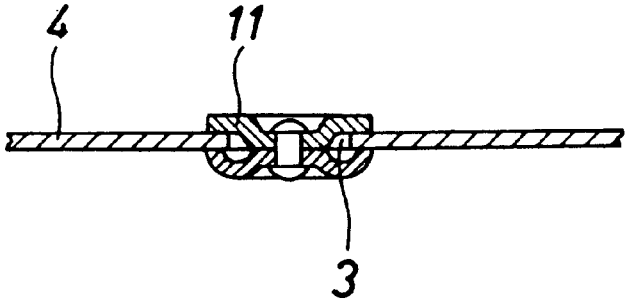
FIG. 2 is a cross sectional view of a filling opening as in FIG. 1 with a riveted closure.

On the one hand, the filling opening 3 may be a hole prepared in the outer shell 4, which is closed again after the introduction of the glass wool, e.g., by a welded closure 10 in the form of a plug welded to the outer shell 4, as it is shown in FIG. 1, or by a riveted closure 11, as it is illustrated in FIG. 2.

Figure 3:
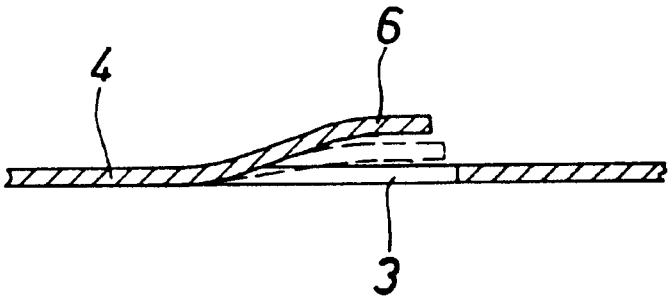
FIG. 3 is a cross sectional view of a third filling opening type in the form of a bent-up incision in the outer shell of the exhaust muffler body.

The filling opening may also be prepared by a U-shaped incision in the outer shell 4, as it is shown in FIG. 3. After an incision, the incised section 6 is deformed or bent up in order to ultimately form the filling opening 3. After the introduction of the glass wool 2, the bent-up section 6 is again restored to its original shape and welded.

Furthermore, the filling opening 3 may be prepared by deforming the outer shells 4 in the area of an axial end of the outer shells 4, so that a gap 7 or a filling channel according to FIG. 4 is formed, through which glass wool 2 can be introduced into the interior of the exhaust muffler. After the introduction of the glass wool, the deformation of the two outer shells 4 is again restored to the original shape, doing so by compressing the two outer shells in that area, so that the gap 7 or the filling channel will be closed. The area of the two half shells bent together is optionally connected by spot welding or seam welding in order to bring about the satisfactory tightness and strength of the exhaust muffler.

As an alternative, not only the outer shell 4, but also the inner shell or the inner pipe 5 may also be deformed radially inwardly in an axial end section of the outer shells 5 in order to form the filling opening 3. After the glass wool has been filled in, the deformed inner pipe 5 is again bent up exactly to the round shape in order to close the filling opening at the axial end of the outer shells 4.

Finally, the inner shell or the inner pipe 5 may also have a hole 3 or 8 or a perforation on its jacket, which may be used to fill the hollow space 13 with glass wool 2. The hole or the jacket perforation is again closed after the filling by pushing an intermediate pipe 9 coaxially into the inner pipe 5 in a tightly fitting manner and fixing it axially. The latter hole 8 may also be used as a pressure-equalizing hole during filling through another filling opening.

It shall be noted that the filling opening 3 on the outer shell 4 may be provided on the jacket side according to FIG. 1, 2 or 3 or on the front side according to FIG. 4. Furthermore, the filling opening 3 on the inner shell or in the inner pipe 5 may be located on the jacket side according to FIG. 6 or on the front side according to FIG. 5.

Despite the complete design of the exhaust muffler body, even poorly accessible inner hollow spaces 13 may be subsequently packed with glass wool in a satisfactory and simple manner according to the present invention.

Figure 7:
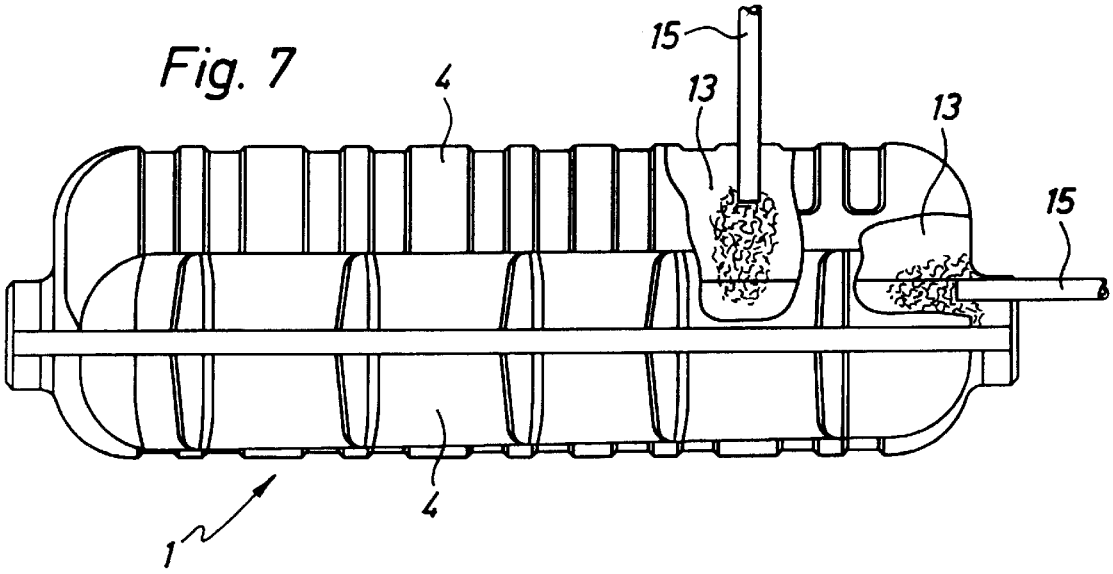
FIG. 7 is a cutaway side view of an exhaust muffler of the shell design with representation of two filling pipes.
Figure 8:
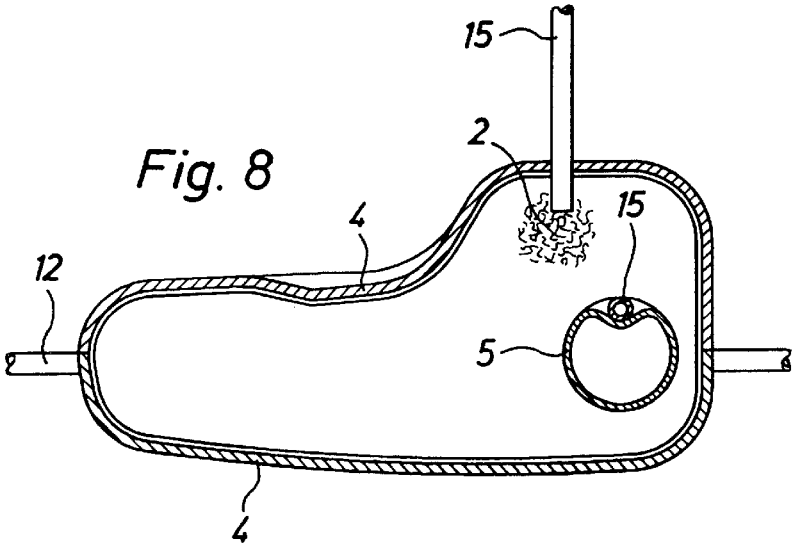
FIG. 8 is a schematic cross sectional view of the exhaust muffler according to FIG. 7 in the area of the filling pipes.

FIGS. 7 and 8 show a shell-type exhaust muffler, which has such hollow spaces 13, which can be filled simultaneously or one after the other through two or one filling pipe 15 on the front side and on the jacket side.

It shall be pointed out that a single hollow space 13 may be filled simultaneously or one after another at a plurality of filling points via filling openings provided there. It is thus always guaranteed that any corner of the hollow space will be filled in a satisfactory manner.

Figure 9:
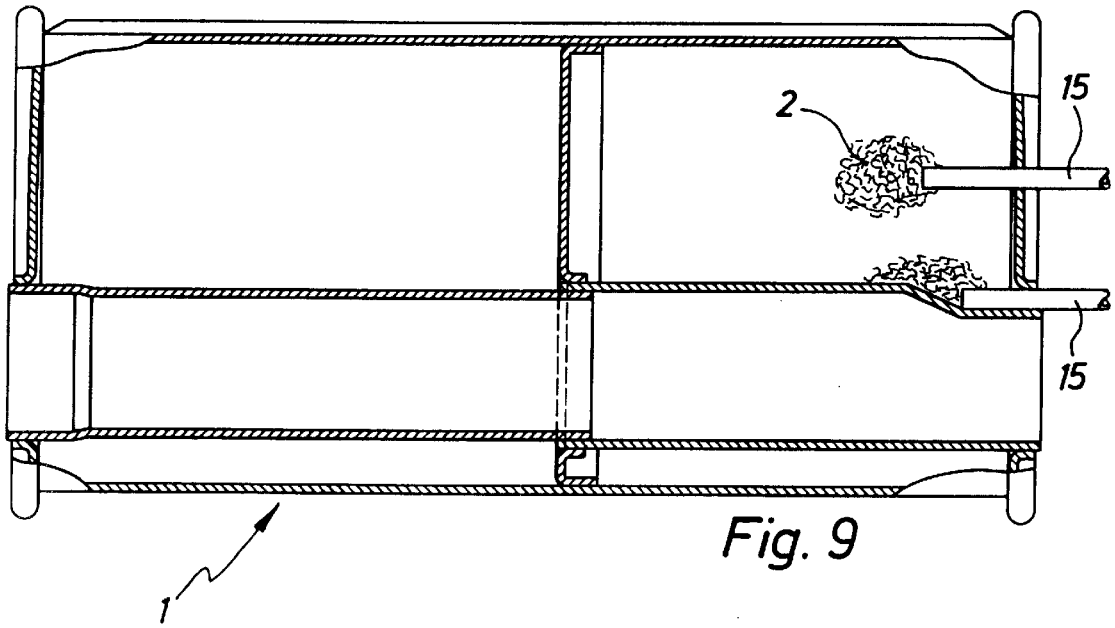
FIG. 9 is a schematic longitudinal cross sectional view of an exhaust muffler of wound design with representation of two filling pipes.
Figure 10:
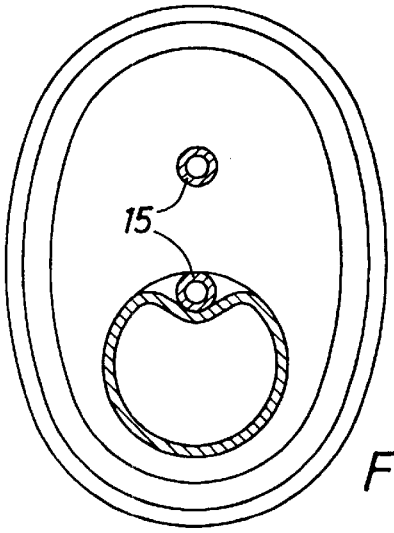
FIG. 10 is a front view of the exhaust muffler according to FIG. 9.

FIGS. 9 and 10 show a wound exhaust muffler, which likewise has a plurality of filling openings (on the front side here), through which filling or packing of the hollow spaces 13 is possible via filling pipes 15.

While specific embodiments of the invention have been shown and described in detail to illustrate the application of the principles of the invention, it will be understood that the invention may be embodied otherwise without departing from such principles.

What is claimed is:

1. A process for preparing an absorption muffler for motor vehicles with a sound-absorbing material arranged in a hollow space of an exhaust muffler body in form of said glass wool, the process comprising the steps of:

completely prefabricating and assembling the exhaust muffler body;

subsequently introducing the glass wool from outside the prefabricated, assembled exhaust muffler body as expanded endless glass fiber roving into the hollow space.

2. The process in accordance with claim 1, wherein said glass wool is introduced by means of at least one rigid filling pipe or a flexible filling tube via one or more filling openings prepared in said exhaust muffler body, and said filling pipe or the filling tube is again removed from the filling opening after the introduction of said glass wool.

3. The process in accordance with claim 2, wherein said glass wool is pressed into said hollow space of said exhaust muffler body under pressure through said filling pipe or filling tube and/or it is drawn into the interior of said exhaust muffler body by vacuum.

4. The process in accordance with claim 2, wherein said one or more filling openings are prepared after said step of prefabricating and assembling said exhaust muffler body and are closed after the introduction of said glass wool.

5. The process in accordance with claim 4, wherein an outer skin or outer jacket of said exhaust muffler body is incised for preparing said one or more filling openings, and said incised section is deformed and is restored to its original shape.

6. The process in accordance with claim 4, wherein said front-side filling gap between said inner pipe and said outer skin or outer shell of said exhaust muffler body, which said outer skin or outer shell is bulged out at the end, is again closed.

7. The process in accordance with claim 1, wherein said glass wool is introduced via an inner pipe of said exhaust muffler body which is within an outer skin or outer shell of said exhaust muffler body, said inner pipe being partially deformed on a circumference at an end to define a filling opening and being restored to its original shape after the introduction of said glass wool.

8. The process in accordance with claim 1, wherein after the introduction of said glass wool into the hollow space of said exhaust muffler body, a hole or a jacket perforation in an inner shell or in an inner pipe is again closed by pushing an intermediate pipe into said inner shell or into said inner pipe.

9. An absorption exhaust muffler, comprising:

a muffler body of a half-shell or wound design, said muffler body defining a hollow space and having an outer outer shell with at least one filling opening;

a sound-absorbing material arranged in said hollow space, said material being in the form of glass wool, said exhaust muffler body being completely prefabricated and assembled prior to introducing the glass wool through said filing opening from outside the prefabricated, assembled exhaust muffler body as expanded endless glass fiber roving into the hollow space, and said filling opening is closed after the introduction of said glass wool.

10. The exhaust muffler in accordance with one of the claim 9, wherein said exhaust muffler body is provided with said glass wool and has a pressed-on outer shell or an at least partially compressed outer shell.

11. The exhaust muffler in accordance with claim 9, wherein said muffler body includes an inner shell deformed at least partially on its circumference or a deformed inner pipe for introducing said glass wool which is restored to its original shape.

12. An absorption exhaust muffler, comprising:

a muffler body of a half-shell or wound design, said muffler body defining a hollow space, said muffler body having one or more filling openings prepared in said exhaust muffler body;

a sound-absorbing material arranged in said hollow space, said material being in the form of glass wool, the exhaust muffler being formed by the steps of:

completely prefabricating and assembling the exhaust muffler body;

subsequently introducing the glass wool from outside the prefabricated, assembled exhaust muffler body as expanded endless glass fiber roving into the hollow space, said glass wool is introduced by means of at least one rigid filling pipe or a flexible filling tube via said one or more filling openings prepared in said exhaust muffler body, and said filling pipe or the filling tube is removed from the filling opening after the introduction of said glass wool and wherein said glass wool is pressed into said hollow space of said exhaust muffler body under pressure through said filling pipe or filling tube and/or it is drawn into the interior of said exhaust muffler body by vacuum, said one or more filling openings are prepared before or after said step of prefabricating and assembling said exhaust muffler body such that an outer skin or outer jacket of said exhaust muffler body is incised for preparing said one or more filling openings, and said incised section is deformed and is restored to its original shape.

13. An absorption exhaust muffler, comprising:

a muffler body defining a hollow space and having an outer shell with at least one filling opening;

a sound-absorbing material arranged in said hollow space, said material being in a form of glass wool, said exhaust muffler body being prefabricated and assembled prior to introducing the glass wool through said filing opening from outside the prefabricated, assembled exhaust muffler body as expanded endless glass fiber roving into the hollow space;

a welded closure in the form of a welded plug arranged in said filling opening.

14. An absorption exhaust muffler, comprising:

a muffler body defining a hollow space and having an outer shell with at least one filling opening;

a sound-absorbing material arranged in said hollow space, said material being in the form of glass wool, said exhaust muffler body being prefabricated and assembled prior to introducing the glass wool through said filing opening from outside the prefabricated, assembled exhaust muffler body as expanded endless glass fiber roving into the hollow space;

a riveted closure arranged in said filling opening.

15. An absorption exhaust muffler, comprising:

a muffler body defining a hollow space, said muffler body having an outer shell and an inner pipe with at least one filling opening;

a sound-absorbing material arranged in said hollow space, said material being in the form of glass wool, said exhaust muffler body being prefabricated and assembled prior to introducing the glass wool through said filing opening from outside the prefabricated, assembled exhaust muffler body as expanded endless glass fiber roving into the hollow space;

an intermediate pipe arranged in said inner pipe and closing said filling opening.

16. A process for preparing an absorption muffler, the process comprising the steps of:

prefabricating and assembling the exhaust muffler body with an outer shell;

incising and deforming said outer shell to define a filling opening;

introducing glass wool through said filling opening as expanded endless glass fiber roving;

restoring said outer shell to its original shape to close said filling opening.

17. A process for preparing an absorption muffler, the process comprising the steps of:

prefabricating and assembling the exhaust muffler body with an outer shell and an inner pipe, one of said inner pipe and said outer shell being bulged to define a filling gap between said inner pipe and said outer shell of said exhaust muffler body;

introducing glass wool through said filling gap as expanded endless glass fiber roving, closing said bulged inner pipe or outer shell after said introducing of said glass wool.

18. A process for preparing an absorption muffler, the process comprising the steps of:

providing an outer shell and an inner pipe;

connecting said outer shell and said inner pipe to form a muffler body;

providing a filling opening in said muffler body;

inserting a filling pipe through said filling opening and passing glass wool through said pipe to arranged said glass wool in said muffler body, said filling opening having a size approximately equal to a size of said filling pipe;

removing said filling pipe from said muffler body;

closing said filling opening.

* * * * *